US009518343B2

(12) United States Patent
Gerth et al.

(10) Patent No.: US 9,518,343 B2
(45) Date of Patent: Dec. 13, 2016

(54) HEDDLE PREFERABLY FOR HANDLING STRIP-SHAPED MATERIAL AND METHOD FOR THE PRODUCTION THEREOF

(71) Applicant: Groz-Beckert KG, Albstadt (DE)

(72) Inventors: Christian Gerth, Albstadt (DE); Rainer Grossman, Schwenningen (DE); Mario Gusenko, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 35 days.

(21) Appl. No.: 14/441,099

(22) PCT Filed: Nov. 5, 2013

(86) PCT No.: PCT/EP2013/003316
§ 371 (c)(1),
(2) Date: May 6, 2015

(87) PCT Pub. No.: WO2014/072041
PCT Pub. Date: May 15, 2014

(65) Prior Publication Data

US 2015/0292128 A1 Oct. 15, 2015

(30) Foreign Application Priority Data

Nov. 8, 2012 (EP) ..... 12191836
Jul. 23, 2013 (EP) ..... 13003701

(51) Int. Cl.
*D03C 9/04* (2006.01)
*D03C 9/02* (2006.01)
(Continued)

(52) U.S. Cl.
CPC ..... *D03C 9/02* (2013.01); *B21F 45/08* (2013.01); *D03C 9/024* (2013.01); *D03C 9/06* (2013.01); *D03C 9/0608* (2013.01); *D03D 41/008* (2013.01)

(58) Field of Classification Search
CPC ..... D03C 9/024; D03C 9/02; D03C 9/028
See application file for complete search history.

(56) References Cited

U.S. PATENT DOCUMENTS 5,069,256 A * 12/1991 Goodman, Jr. ..... D03C 13/00 139/55.1
5,113,913 A * 5/1992 Graf ..... D03C 9/065 139/88

(Continued)

FOREIGN PATENT DOCUMENTS

CN 1940157 A 4/2007
CN 201924128 U 8/2011

(Continued)

OTHER PUBLICATIONS

European Search Report and Opinion in European Application No. 12 19 1836, dated Jan. 14, 2013, 8 pages.

(Continued)

*Primary Examiner* — Bobby Muromoto, Jr.
(74) *Attorney, Agent, or Firm* — Fitch, Even, Tabin & Flannery LLP

(57) ABSTRACT

A heddle (1), preferably for the processing of tape-like material, includes at least two bands (2, 3), which form the heddle shaft (24). At least one component (6, 7), which limits a thread eye (8), or one of the two bands (2, 3) has at least one fastening element (9, 10), which connects the component and the band. The two bands (2, 3) make mutual contact above and below the thread eye (8) at joins (13, 14). At least one join (13, 14) is spaced from the thread eye (8) by a distance A, which is, at the most, half as great as the distance (D) between the thread eye (8) and the end loop (17) nearest in each case to the join (13, 14).

15 Claims, 7 Drawing Sheets

(51) Int. Cl.

| | |
|---|---|
| ***D03D 41/00*** | (2006.01) |
| ***D03C 9/06*** | (2006.01) |
| ***B21F 45/08*** | (2006.01) |
| *D03C 9/00* | (2006.01) |

(56) References Cited

U.S. PATENT DOCUMENTS

| | | | | |
|---|---|---|---|---|
| 5,136,762 | A * | 8/1992 | Gironi | D03J 1/14 28/201 |
| 6,283,163 | B1 * | 9/2001 | Kagi | D03C 9/028 139/93 |
| 7,131,465 | B1 * | 11/2006 | Chapman | D03C 9/02 139/380 |
| 7,281,548 | B2 * | 10/2007 | Schmid | D03C 9/02 139/93 |
| 7,467,646 | B2 * | 12/2008 | Mettler | D03C 9/02 139/92 |
| 7,469,723 | B2 * | 12/2008 | Himmelstoss | D03C 9/024 139/52 |
| 7,963,301 | B2 * | 6/2011 | Stauss | D03C 9/02 139/35 |
| 8,333,222 | B2 * | 12/2012 | Leppla | D03D 35/00 139/192 |
| 2005/0011577 | A1 * | 1/2005 | Froment | D03C 9/02 139/93 |
| 2006/0011252 | A1 * | 1/2006 | Schmid | D03C 9/02 139/93 |
| 2006/0048836 | A1 * | 3/2006 | Bruske | D03C 9/0691 139/82 |
| 2007/0084518 | A1 * | 4/2007 | Himmelstoss | D03C 9/02 139/11 |
| 2011/0155276 | A1 * | 6/2011 | Leppla | D03D 35/00 139/22 |
| 2015/0292128 | A1 * | 10/2015 | Gerth | D03C 9/02 139/93 |

FOREIGN PATENT DOCUMENTS

| | | | |
|---|---|---|---|
| CN | 102177286 | A | 9/2011 |
| DE | 2351795 | A1 | 4/1975 |
| DE | 102007048761 | A1 | 4/2009 |
| EP | 1015675 | B1 | 7/2001 |
| EP | 1795635 | A1 | 6/2007 |
| EP | 1795636 | A1 | 6/2007 |
| EP | 2166138 | A1 | 3/2010 |
| JP | 2001-303383 | A | 10/2001 |
| JP | 2007154405 | A | 6/2007 |
| JP | 2007154406 | A | 6/2007 |
| JP | 2008045255 | A | 2/2008 |
| WO | 2010105314 | A2 | 9/2010 |
| WO | 2010121810 | A1 | 10/2010 |
| WO | 20141072332 | A1 | 5/2014 |

OTHER PUBLICATIONS

European Search Report and Opinion in European Application No. 13 00 3701, dated Jan. 20, 2012, 12 pages.

Notice of Reasons for Refusal in Japanese Application No. 2015-541033, dated Dec. 24, 2015, 9 pages.

Notice of Reason for Refusal in Korean Application No. 10-2015-7011798, dated Oct. 21, 2015, 7 pages.

Office action and Search Report in Chinese Application No. 201380058225.6, dated Mar. 29, 2016, 2 pages.

Office Action in European Application No. 13 003 7001, dated Jan. 5, 2015, 4 pages.

International Search Report in corresponding International Application No. PCT/EP2013I003316, dated Jan. 29, 2014, 6 pages.

International Search Report in corresponding International Application No. PCT/EP2013/073144, dated Jan. 17, 2014, 4 pages.

* cited by examiner

HEDDLE PREFERABLY FOR HANDLING STRIP-SHAPED MATERIAL AND METHOD FOR THE PRODUCTION THEREOF

CROSS REFERENCE TO RELATED APPLICATIONS

This patent application is the national phase of PCT/EP2013/003316 filed Nov. 5, 2013, which claims the benefit of European Patent Application No. 12191836.1 filed Nov. 8, 2012 and European Patent Application No. 13003701.3 filed Jul. 23, 2013.

TECHNICAL FIELD

The subject of this invention is a heddle, preferably for the processing of tape-shaped material, and a method for the manufacture thereof.

BACKGROUND

Heddles and methods for manufacturing them are known. Traditionally, they serve primarily for weaving yarns and wires. Particularly in more recent times, heddles have also been used for weaving tapes. The subject of the EP 1 795 636 B1, for example, is a heddle for tape-shaped warp yarn. The heddle shown there is optimized primarily for the production of industrial fabrics of the kind used, for example, in the manufacture of fibre composites.

The EP 1 795 636 B1 shows a heddle consisting substantially of two bands which are parallel to each other and spaced apart from each other.

Spacers and two rod-like components that form the thread eye are located in the gap between the bands. The spacers, but not the rod-like components forming the thread eye, are provided in part with fastening elements, each of which engages a recess in one of the bands. End loops are provided at both ends of the bands, and the heddle shown in the EP 1 795 636 B1 accordingly has four end loops. The aforementioned publication contains no detailed information concerning the manufacture of the heddles illustrated.

The heddle shown in the EP 1 795 636 B1 is optimized primarily for the production of industrial fabrics of the kind used, for example, in the manufacture of fibre composites. The price of the heddles used in the processing of expensive materials such as CRP yarn is of rather secondary importance.

However, particularly in industrial fields in which manufacturers are under greater pricing pressure than are manufacturers of fibre-composite components, further uses of heddles for the processing of tapes might arise. The manufacture of packaging from tape-like plastic materials, from which woven fabrics are formed, is one such field. For the manufacture of packaging materials of such kind—e.g. sacks—use is made primarily of circular looms.

SUMMARY

The object of the present invention is therefore to propose a heddle that can be produced economically and that is of narrow width, thereby enabling it to be used in difficult installation positions—as in the case of circular weaving.

Joins in the sections in which the two bands make mutual contact, preferably with their flat sides, can also be made economically. Substance-to-substance joining techniques, such as adhesive bonding, welding or soldering, can be used here to advantage. It is also conceivable that other techniques, such as riveting or the use of clips, which result, for example, in a form fit, also offer advantages. Joins at which, for example, the bands penetrate each other or cross over and lock mechanically are also conceivable. The precise shape of the joins is not limited to given shapes, e.g. a round shape, in any of the joining methods cited, but may be completely arbitrary so as to suit the requirements.

Surprisingly, it proved to be advantageous if the distances between the thread eye and the closest joins above and below it are small. The smaller these distances are, for example, the greater is the stability of the heddle. To advantage, for instance, are distances which are less than half, a third, a quarter, a sixth, an eighth or even a tenth of the distance between the thread eye and the end loop on the side in question. It is advantageous if the distance between the thread eye and the end loop is at least 1.5 times the distance between the thread eye and the join.

Additional benefits arise in this context for the following reason: the two bands, which are spaced apart in the area in which the thread eye is incorporated in the heddle, generally exert a force (a force perpendicular to the plane spanned by the longitudinal direction of the heddle and the widthwise direction of the two bands), which opposes the spacing between the two bands and with which the thread eye, or the at least one component limiting the thread eye, can be clamped between the two bands. The smaller the distance between the thread eye and each of the two joins closest thereto, the greater is this clamping force. However, in order to preserve the warp material, it is advantageous if the distance between the thread eye and the closest join is greater than the width of the thread eye. This configuration is gentle particularly on the adjacent warp tapes sliding past the heddle laterally.

In addition, or alternatively, a perpendicular force of this kind may be generated if, in the fitted position, at least one of the bands (or both bands) is/are in a stressed state. This is the case if, for example, in the portion between the two joins closest to the thread eye, the band in question is fully deflected or even lengthened. Hooke's Law, among others, then applies.

The at least one component interlocks by way of a fastening element with at least one of the bands. Often, each such component interlocks by way of a fastening element with each of the two bands. In a useful refinement of the invention, at least one component has fastening elements that engage both the bands. A component of this kind may also have a plurality of fastening elements that engage a band. Engagement of a fastening element with a band may be effected by providing the band with a recess that completely perforates the band. Alternatively, the recess may only partially penetrate the band or even be configured such that "recesses" in the band are created by inwardly projecting material deformations, e.g. without removing any band material. In this or other ways (here, for example, by stamping), fastening elements may also be created on the band, or on both bands, which engage at least one component.

The component is made preferably of a ceramic material but may also be produced, e.g. as a sinterered, MIM or injection-moulded part.

It is to advantage if a fastening element has a surface that makes contact with at least one of the two bands and serves as a stop, thereby halting the relative movement—here an approach—between the band and the fastening element at the point of contact.

Where there is a plurality of fastening elements, the contact surface may be located between the fastening elements. It may then be to advantage to provide a relief groove between the contact surface and the surfaces of each of the fastening elements so as to ensure that the surfaces are executed with the greatest possible precision.

It is also possible to have a plurality of contact surfaces, particularly if a plurality of fastening elements is provided, which may be interconnected, e.g., across the relief grooves.

Rising surfaces may be present, which may serve to ensure that the components forming the thread eye are positioned correctly relative to the bands, and are kept in position, by the perpendicular force exerted by the bands. To this end, the rising surfaces are configured such that the angle between them and the contact surface is not a right angle. This angle may be obtuse or acute. The contact surface may also be only approximately planar or at least feature an angle other than 90° relative to the component's centre line. The contact surface may be adapted shapewise to the deflection curve of the band with which it makes contact. A shapewise adaptation to the deflection of the bands may be advantageous for all the end-face surfaces.

It has proved advantageous if the thread eye is defined by at least two components which limit the thread eye. The components will often have the shape of a bridging member. It is to advantage if at least those parts of the components that come into contact with the yarn or tape-like warp material are rounded.

For a wide variety of reasons, it has proved advantageous if the end-loop portion of the heddle remains free of joins, thereby facilitating suspension of the heddles, which are usually flexible. It is also to advantage if, at least in one end-loop portion but preferably in both end-loop portions, only one heddle band is provided. In cases where there are two bands in at least one end-loop portion, it is possible to configure the end loops of the two bands differently. They may, for example, be shaped superposably and oriented as mirror images, i.e. rotated by 180° relative to one another about the band's longitudinal axis. A further alternative is to shape the end loops of the two bands differently.

The following procedural features are advantageous for manufacturing the heddles described in this publication:

- bringing together of two bands, flat side to flat side, and making at least two joins which connect the bands at least in sections of their surface area (length in the direction in which the heddle extends),
- creation of a space between the two bands in the portion—between the at least two joins (13, 14)—of their extension in the heddle's longitudinal direction,
- insertion of at least one component (6, 7), which limits a thread eye (8), in the space (4).

It is normally advantageous to make notches and recesses in the bands before these are brought together and/or connected. However, these may also be made after the bands have already been brought together or even already connected, particularly if the bands are configured such that they are superposable and/or if they have recesses in the same places. In this case, the creation of recesses by "punching through" is particularly recommendable. Where applicable, even the punching through of more than two bands would appear expedient.

Creation of a space between the two bands in a portion—between the at least two joins—of their extension in the heddle's longitudinal direction may be undertaken after the bands have been brought together and even after formation—for example by spot welding—of the joins. To this end, a wedge may be introduced into the portion of the two bands where they are to be spaced apart. It is to advantage in this context if, in the portion concerned, the two bands are not superposed with zero clearance. A gap between the two bands may be ensured by introducing, before the bands are brought together, a removable spacer into the portion where they are to be spaced apart. The spacer may be removable but may also remain in the spaced-apart portion as a permanent component of the heddle. In this case, the spacer may serve as a component that limits the thread eye.

However, raised impressions in one or both bands may also serve as spacers, provided they are raised relative to the rest of the band's surface and the raised area faces towards the other band. In the aforesaid cases, the spacing tool—a wedge, as a rule, as mentioned—may be inserted into the gap to widen it.

It is also conceivable, however, to configure the diameter of the "gap" such that it need not be widened further by the wedge. In this case, accordingly, the spacer determines the distance by which the two bands will later be spaced apart in the end-loop portion. According to this version of the "procedural features" outlined above, this space is formed as the bands are brought together and not thereafter, meaning that the procedural features for the last-mentioned embodiment do not necessarily follow each other in succession like procedural steps. However, if one first brings the two bands together and then creates a space between them, or, if necessary, widens an existing gap (see the above, first-mentioned embodiment of the production process) the above procedural features follow each other in succession like procedural steps.

In both cases, the result is a portion in which the two bands are spaced apart and into which the thread eye is introduced in some manner. This portion with a gap between the bands extends between the at least two joins.

Further embodiments of the present invention follow from the dependent claims and the description. The description, too, is limited to essential features of the invention, with the individual features generally being applicable to advantage in all the embodiments.

The drawings supplement the description.

The technical features of the individual embodiments can generally be used to advantage in connection with all the embodiments of the invention.

A number of selected embodiments of the invention are described below by reference to the drawings.

DETAILED DESCRIPTION

Figure 1:
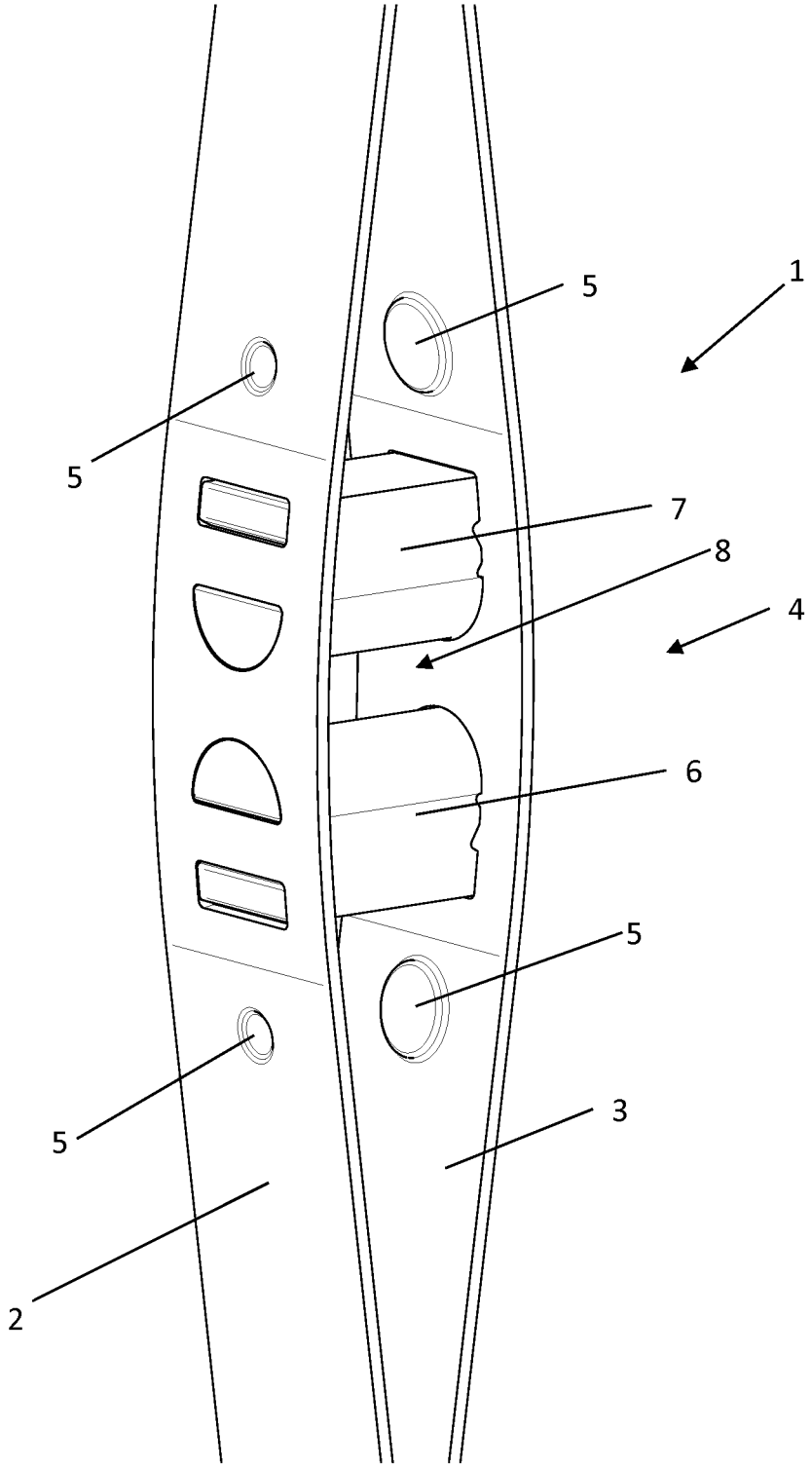
FIG. 1 shows a perspective view of the thread-eye portion of a heddle.
Figure 2:
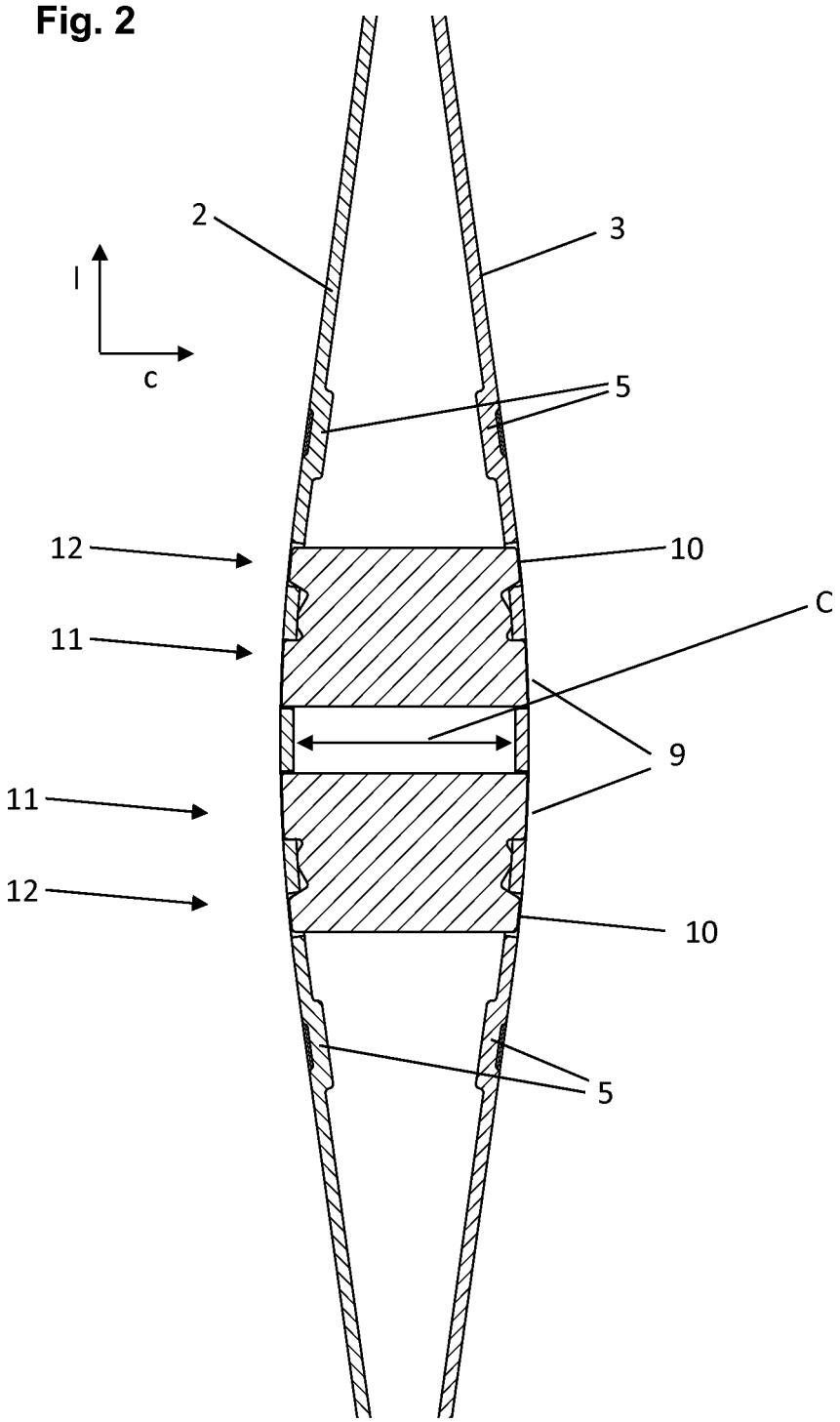
FIG. 2 shows a cut view of the heddle illustrated in FIG. 1.

FIGS. 1 and 2 show the spaced apart area 4 of an embodiment of a heddle 1 according to the invention, which is composed of the two bands 2 and 3. Prior to their being connected, the two bands 2, 3 were provided in this embodiment with raised impressions 5, which served as spacers during production of the heddle 1.

Two components 6, 7, which limit the thread eye 8, are held between the two bands 2 and 3. In the embodiment shown, the two components 6, 7 have fastening elements 9, 10 which engage recesses 11, 12 in the two bands 2, 3. In the embodiment shown, the recesses 11, 12 are holes which perforate the bands. However, blind holes created, for example, by stamping or notching are also conceivable.

Figure 3:
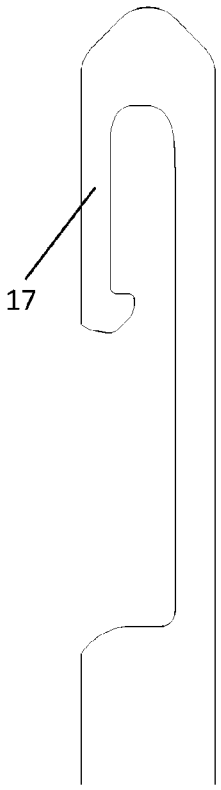
FIG. 3 shows an end-loop portion shaped by two (mirror inverted) identically shaped, superposed band-end portions.
Figure 4:
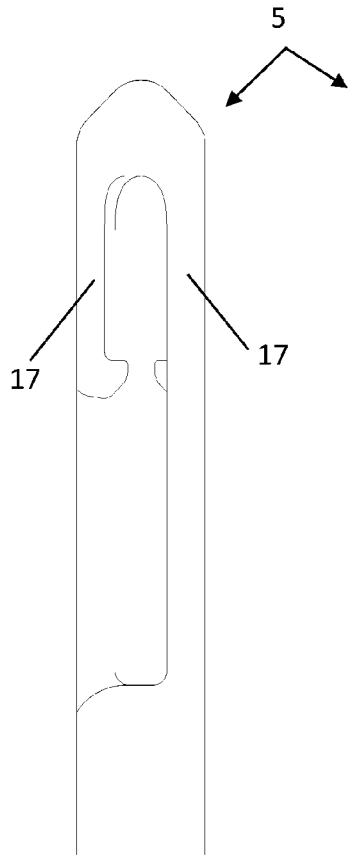
FIG. 4 shows a heddle end-loop portion consisting of two superposable band-end portions positioned such as to be mutually mirror-inverted.
Figure 5:
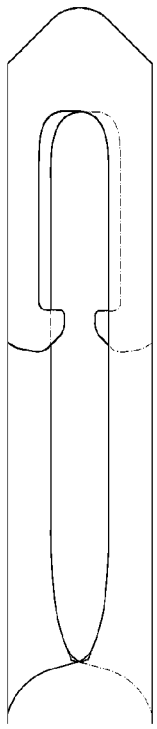
FIG. 5 shows the same end-loop portion of a heddle as in FIG. 4, which likewise consists of two superposable band-end portions positioned such as to be mutually mirror-inverted.
Figure 6:
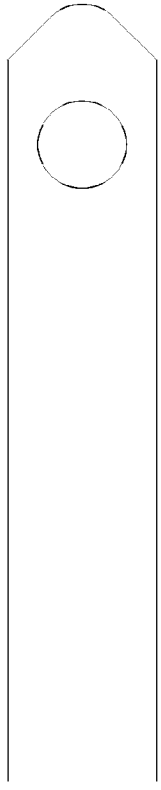
FIG. 6 shows an end-loop portion shaped by two identically shaped, superposed band-end portions with an alternative end-loop shape.
Figure 8:
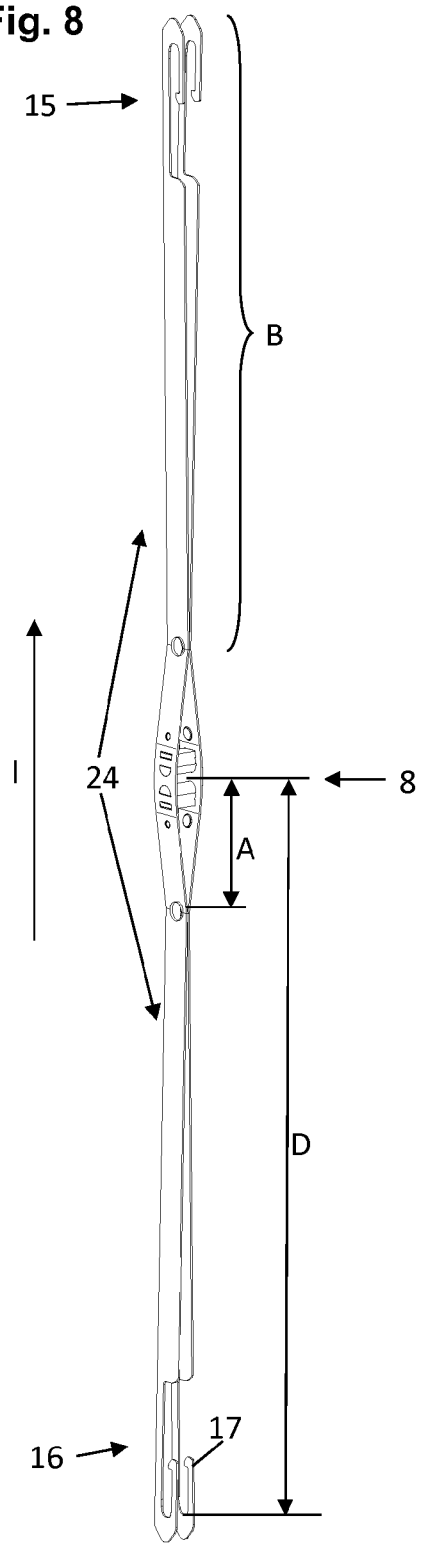
FIG. 8 shows a perspective overall view of the heddle of FIG. 1.
Figure 9:
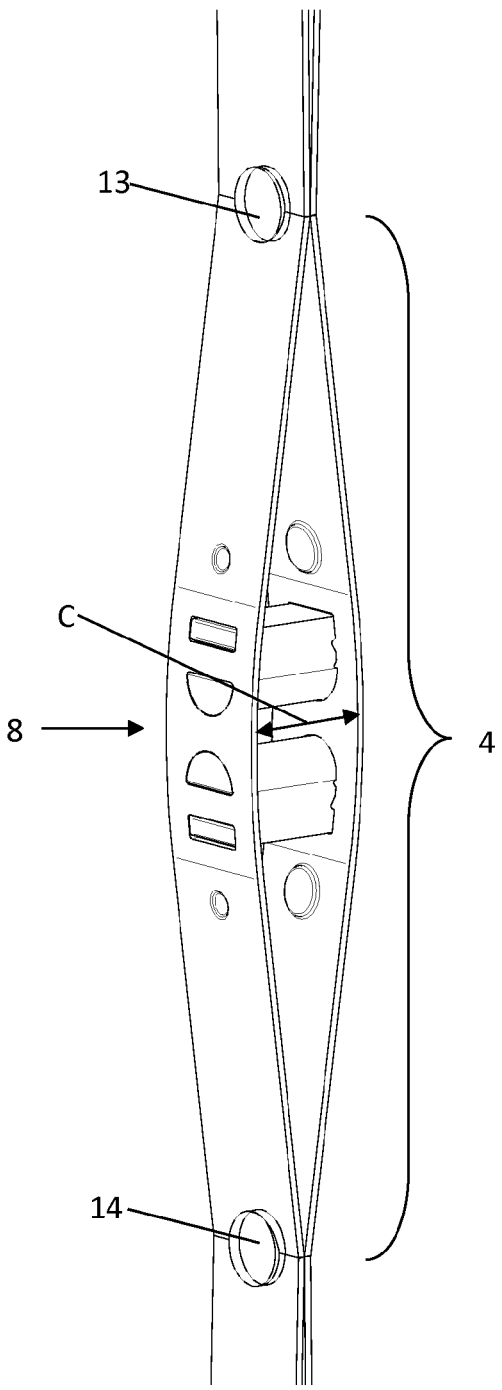
FIG. 9 shows a perspective view of the thread-eye portion of the heddle illustrated in FIGS. 1, 2 and 8.

FIGS. 8, 9, 11, 12 and 13 also show overall views or elements of the heddle 1 of FIGS. 1 and 2. It is clear from FIGS. 8 and 9 that the two bands 2 and 3 are held together by the two joins 13 and 14. It is also conceivable to hold the two bands together by three, four, five or more joins 13, 14, or to extend the joins further in the longitudinal direction of the heddle 1. No joins 13, 14 are located in the area of the end loops 15 and 16 since—as already mentioned above—it is more advantageous to position them in the vicinity of the thread eye 8. FIG. 8 also shows the distances D, A and B mentioned in the description. D extends here, in the heddle's longitudinal direction L, from the centre of the thread eye 8 to the end of the inner edge of the end loop, with which the heddle is suspended on the support rail. A extends, in the heddle's longitudinal direction L, from the centre of the thread eye 8 to the beginning of the join 13 on the side of the join 13 facing towards the thread eye 8. FIG. 8 also shows that the heddle has J-shaped end loops. C-shaped end loops instead of J-shaped end loops are possible in this and all other embodiments of the invention. The end loops 17 of the two bands 2 and 3 are identically shaped and identically oriented in each end-loop area 15, 16. FIG. 3 shows a frontal view of the upper end-loop portion 15 of the heddle 1 illustrated in FIG. 8; only the end loop 17 at the front in this view is visible. FIGS. 4 and 5 show an end-loop portion 15 in which the end loops 17 are identically shaped as in FIG. 3. However, the orientation of the end loops 17 of the two bands 2 and 3 is different: the two end loops 17 have been mutually counter-rotated about the longitudinal axis of the bands.

Figure 10:
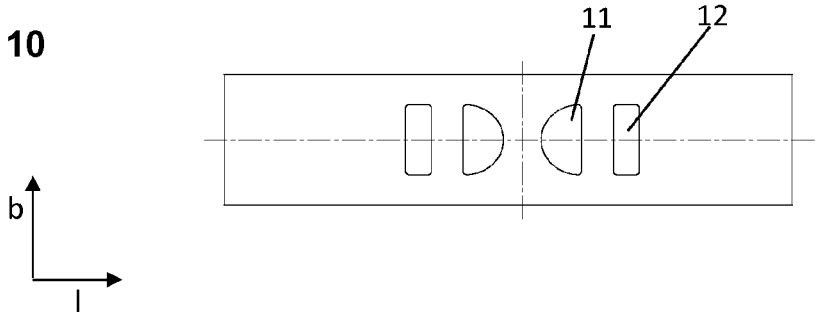
FIG. 10 shows the band 3 of FIG. 1.
Figure 11:
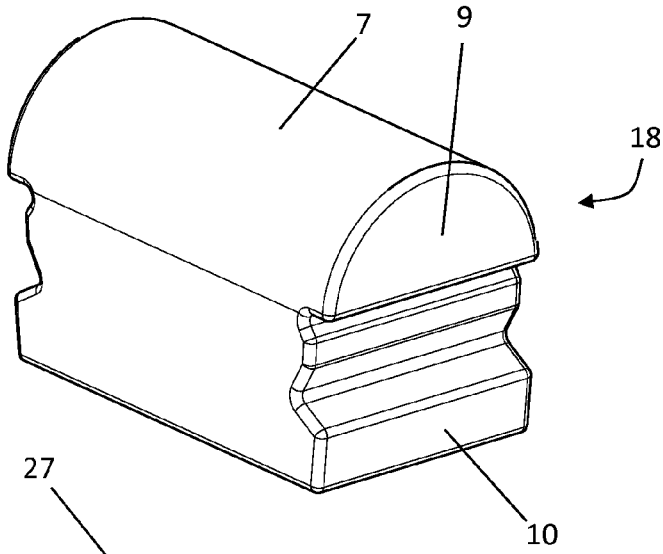
FIG. 11 shows the component 7 of FIG. 1.
Figure 12:
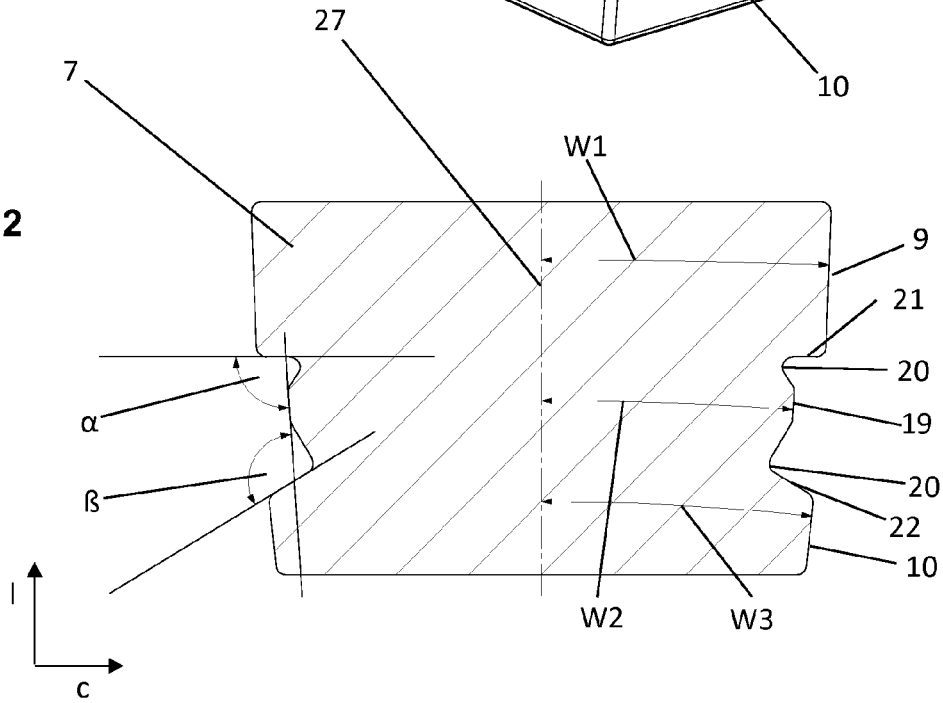
FIG. 12 shows a cut view of the component 7 of FIG. 1.

FIGS. 10 to 12 serve to clarify once again the exact function of the recesses 11, 12 and of the fastening elements 9 and 10 in the embodiment according to FIGS. 1 and 2. The component 7 shown in FIGS. 11 and 12 has, in each of its end faces 18, two fastening elements 9 and 10 that engage the recesses 11 and 12 of the bands 2, 3. The fastening elements 9 and 10 are raised relative to the contact surface 19. The contact surface limits movement of the components 7 towards the respective band 2, 3 and thus functions as a stop. The angle between the contact surface 19 and the upper rising surface 21 is a right angle α. The angle β between the lower rising surface 22 and the contact surface 19 is not a right angle (and is obtuse). Relief grooves 20 are made in the component 7 between the rising surfaces 21 and 22.

The fastening-element configuration shown in the aforementioned three drawings is particularly advantageous. It is to be noted in this context that the surfaces of the end face are not parallel to the centre line 27, shown in FIG. 12, of the component 7. The angle W1 between the end face of the fastening element 9 and the centre line 27 shows the smallest deviation from 90° towards lower values. The angles W2 and W3 deviate from 90° by more, as the component is adapted to the band's deflection curve. The angle W3 is enclosed between the end face of the fastening element 10 and the centre line 27. The angle W2 is enclosed between the centre line 27 and the contact surface 19.

Figure 7:
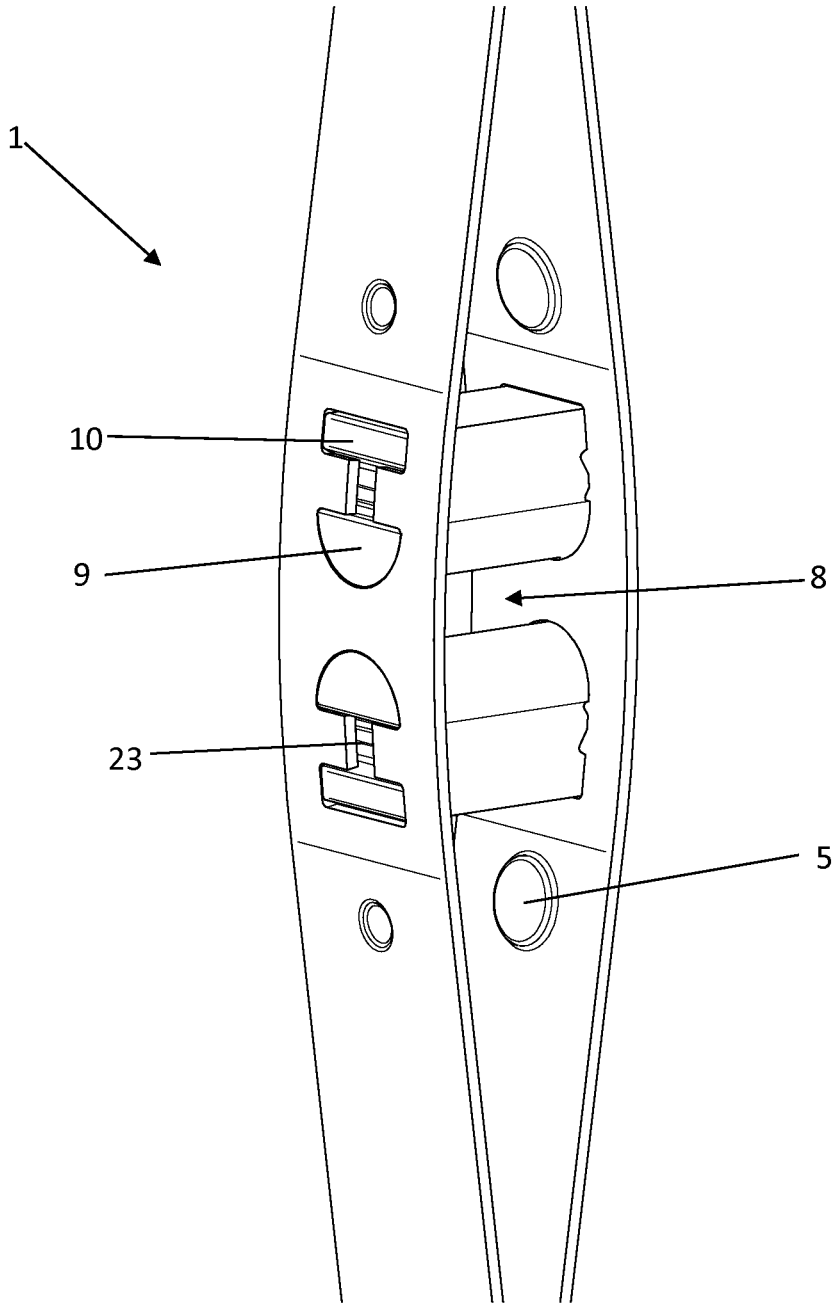
FIG. 7 shows a perspective view of the thread-eye portion of another embodiment of a heddle.

FIG. 7 shows the area of the thread eye 8 of another heddle according to the invention, making it clear that the recesses 11, 12 and the fastening elements 9, 10 may also be configured in a different manner. In this embodiment, the fastening elements 9, 10 are interconnected by a bridge 23. Accordingly, the recesses 11, 12 are connected by a groove.

Figure 13:
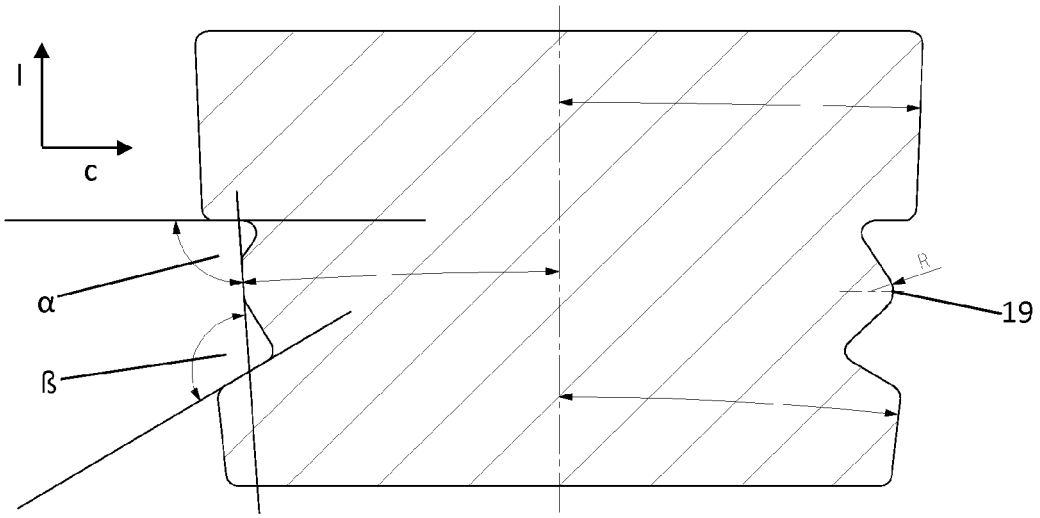
FIG. 13 shows a cut view of an alternative embodiment of the component 6.

FIG. 13 shows a modification of the component 7. Seen in cross section, the contact surface 19, on the right in the drawing, is configured here as an arc-shaped surface with no straight area (the plane of the drawing is spanned here by the longitudinal direction I of the heddle and the spatial direction c of the width C of the thread eye 8).

Figure 14:
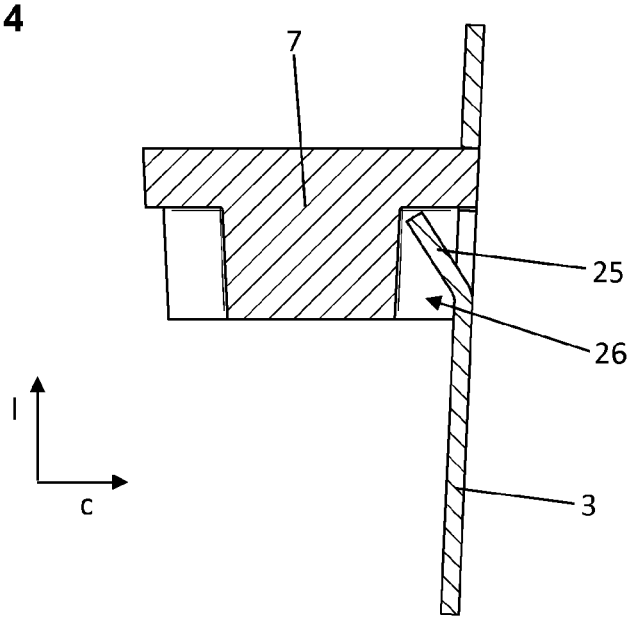
FIG. 14 shows a section through part of another embodiment of the invention.

FIG. 14 shows a section through a portion of another embodiment of the invention, in which the fastening element 25 is part of the band 3. The fastening element engages a recess 26 of the component 7, which limits a thread eye 8. Having a plurality of such fastening elements 25 is advantageous in all the embodiments of the invention. These fastening elements, which may be provided on both bands 2, 3, may engage one or more components 6, 7.

List of reference numerals

| | |
|---|---|
| 1 | Heddle |
| 2 | Band, left |
| 3 | Band, right |
| 4 | Space |
| 5 | Raised impression |
| 6 | Component limiting the thread eye, top |
| 7 | Component limiting the thread eye, bottom |
| 8 | Thread eye |
| 9 | Semicircular fastening element |
| 10 | Rectangular fastening element |
| 11 | Semicircular recess |
| 12 | Rectangular recess |
| 13 | Upper join |
| 14 | Lower join |
| 15 | End-loop portion, top |
| 16 | End-loop portion, bottom |
| 17 | End loop, J-shaped |
| 18 | End face of component 7 |
| 19 | Contact surface |
| 20 | Relief groove |
| 21 | Upper rising surface |
| 22 | Lower rising surface |
| 23 | Bridge |
| 24 | Heddle shaft |
| 25 | Fastening element, band 3 |
| 26 | Recess in component 7 |
| 27 | Centre line of component 7 |
| α | Right angle |
| β | Obtuse angle |
| A | Distance between join 13, 14 and thread eye 8 |
| B | End-loop area, which is free of joins |
| C | Width of the thread eye |
| D | Distance between thread eye 8 and end loop 17 |
| W1 | Angle between centre line and end face |
| W2 | Angle between centre line and contact surface |

-continued

| List of reference numerals | |
|---|---|
| W3 | Angle between centre line and end face |
| l | Spatial direction in the heddle's longitudinal direction |
| b | Spatial direction in the bands' widthwise direction |
| c | Spatial direction in the direction of the width C of the thread eye 8. |

The invention claimed is:

1. A heddle comprising:

at least two bands (2, 3), which form a heddle shaft (24), at least one component (6, 7), which limits a thread eye (8), at least two end loops (17)

wherein the at least one component (6, 7) has at least one fastening element (9, 10) that engages (9, 10) a recess (11, 12) in a first of the at least two bands, and/or at least one of the two bands (2, 3) has at least one fastening element (25) that interlocks with at least one component (6, 7), wherein the at least two bands (2, 3) forming the heddle shaft (24) make mutual contact, at least section-wise, above and below the thread eye (8) at joins (13, 14), and wherein at least a first (13) of the joins above the thread eye or at least a second join (14) of the joins below the thread eye (8) is spaced from the thread eye (8) by a distance (A) which is less than half a distance (D) between the thread eye (8) and an end loop (17) of the least two end loops nearest to the respective join (13, 14).

2. The heddle of claim 1 wherein the distance (A) is less than a third of the distance (D).

3. The heddle of claim 1 wherein the distance (A) is less than half the distance (D).

4. The heddle of claim 1 wherein the at least one component (6, 7) limiting the thread eye (8) is held between the at least two bands (2, 3) at least by a force perpendicular to a longitudinal direction (L) of the heddle.

5. The heddle of claim 1 wherein in its fitted position in the heddle (1), at least one of the at least two bands (2, 3) is in a mechanically stressed state between the joins (13, 14).

6. The heddle of claim 1 wherein the at least one component (6, 7) limiting the thread eye (8) interlocks, by way of a fastening element (9, 10), with at least one of the at least two bands (2, 3) and has a contact surface (19) which makes contact with the at least one of the at least two bands and which opposes movement of the at least one component (6, 7) towards the at least one of the at least two bands (2, 3) when the at least one component (6, 7) is in a fitted position.

7. The heddle of claim 1 wherein at least two components (6, 7), which limit the thread eye (8) and which each have at least one fastening element (9, 10) that interlocks (9, 10) with at least one of the at least two bands (2, 3).

8. The heddle of claim 6 wherein the at least one component (6, 7) limiting the thread eye (8) interlocks by way of at least two fastening elements (9, 10) with at least one of the at least two bands (2, 3), and wherein the at least one contact surface (19) is between the at least two fastening elements (9, 10).

9. The heddle of claim 6 wherein:

the contact surface (19) runs largely parallel to a surface of the one of the at least two bands (2, 3) with which it makes contact (19), two of the fastening elements (9, 10) are raised relative to the contact surface (19), at least one of the two fastening elements (9, 10) rises, along a rising surface, relative to the contact surface (19), and the contact surface (19) and the rising surface (22) of the at least one of the two fastening elements (9, 10) include an angle (β), which deviates from a right angle.

10. The heddle of claim 9 wherein the rising surface (22) of the at least one fastening element (10) is on a side of the fastening element (10) facing towards the thread eye (8).

11. The heddle of claim 1 wherein at least one of the at least two end-loops (17) includes a portion (15, 16) free of joins (13, 14).

12. The heddle of claim 11 wherein the portion (15, 16), which is free of joins (13, 14), has a length B that corresponds to at least a quarter of a distance between the thread eye (8) and the portion's respective end loop (17).

13. The heddle of claim 1 wherein at least two of the at least two bands (2, 3) extend into an end-loop (17) portion, and wherein, in the end-loop portion, the at least two of the at least two bands (2, 3) are not superposed.

14. Method for the manufacture of a heddle, the method comprising:

bringing together of two bands (2, 3), flat side to flat side, and making at least two joins (13, 14) which connect the two bands (2, 3) at least in sections of their surface area, creating a space between the two bands—between the at least two joins (13, 14)—of their extension in the heddle's longitudinal direction (L), inserting at least one component (6, 7), which limits a thread eye (8), in the space.

15. The method of claim 14 further comprising before bringing together the two bands (2, 3), making notches, raised impressions (5) and/or recesses (11, 12).

* * * * *